United States Patent [19]

Anderíe

[11] Patent Number: 4,949,476

[45] Date of Patent: Aug. 21, 1990

[54] RUNNING SHOE

[75] Inventor: Wolf Anderíe, Herzogenaurach, Fed. Rep. of Germany

[73] Assignee: Adidas Sportschuhfabriken, ADI Dassler Stiftung & Co. Kg., Herzogenaurach, Fed. Rep. of Germany

[21] Appl. No.: 301,885

[22] PCT Filed: Mar. 17, 1988

[86] PCT No.: PCT/DE88/00164

§ 371 Date: Dec. 21, 1988

§ 102(e) Date: Dec. 21, 1988

[87] PCT Pub. No.: WO88/08263

PCT Pub. Date: Nov. 3, 1988

[30] Foreign Application Priority Data

Apr. 24, 1987 [DE] Fed. Rep. of Germany ... 8705947[U]
Jul. 1, 1987 [DE] Fed. Rep. of Germany ... 8709091[U]

[51] Int. Cl.[5] ..... A43B 5/06
[52] U.S. Cl. ..... 36/129; 36/114
[58] Field of Search ..... 36/114, 129, 134

[56] References Cited

U.S. PATENT DOCUMENTS

| | | | |
|---|---|---|---|
| 2,095,766 | 10/1937 | Shapiro | 36/129 |
| 2,758,394 | 8/1956 | Whitlock | 36/129 |
| 3,028,689 | 4/1962 | Dassler | 36/129 |
| 3,918,181 | 11/1975 | Inohara | 36/129 |
| 4,187,623 | 2/1980 | Dassler | 36/129 |
| 4,212,120 | 7/1980 | Bowerman et al. | 36/129 |
| 4,361,971 | 12/1982 | Bowerman | 36/129 |

FOREIGN PATENT DOCUMENTS

| | | | |
|---|---|---|---|
| 1014462 | 8/1957 | Fed. Rep. of Germany | 36/129 |
| 2720849 | 11/1978 | Fed. Rep. of Germany . | |
| 2805426 | 8/1979 | Fed. Rep. of Germany | 36/129 |
| 3115488 | 4/1981 | Fed. Rep. of Germany . | |
| 2481086 | 10/1981 | France | 36/129 |

*Primary Examiner*—Paul T. Sewell
*Assistant Examiner*—Andrew D. Meyers
*Attorney, Agent, or Firm*—Hoffman & Baron

[57] ABSTRACT

A running shoe comprising a front sole of hard plastic material for mounting gripping elements, and a support member arranged behind the rearmost gripping elements, of elastically deformable material. In order to ensure that it is better possible to maintain a foot attitude required for optimum running efficiency, the support member is a wedge member which increases in thickness in a rearward direction and which comprises a relatively hard but elastically pressure-deformable material, wherein the underside thereof is disposed approximately in one plane with the front sole, and the wedge member extends at least with its portion associated with the outer edge of the sole, into the shank region of the sole.

6 Claims, 2 Drawing Sheets

1
2
3
4
5
7
8
I
II 1
2
5
6
8
II

RUNNING SHOE

FIELD OF THE INVENTION

The invention relates to an improved running shoe.

BACKGROUND OF THE INVENTION

When a runner is running at high speed and in particular when he is sprinting, the rolling movement of the foot does not take place in the usual manner from the heel which is first put on the ground. On the contrary, the heel scarcely comes into contact with the ground or does not come into contact with it at all, as the runner first puts the stretched-out foot on to the track in the region of the outside part of the ball of the foot, and it is from there that a rolling movement towards the inside part of the ball of the foot takes place. When the foot is put on to the ground with the outside region of the ball of the foot, that is to say at the first moment of making contact with the ground, the runner first tries to achieve contact with the track, that is to say secure support on the track, in order then immediately to apply leg power to the ground by means of the gripping elements which are fixed to the hard front sole portion of the shoe, during the rolling movement of the foot towards the inward side of the ball of the foot. That first contact with the track in the region of the outside part of the ball of the foot is of essential significance in regard to sure-footed running and in regard to optimum efficiency on the part of the runner, as it is that first contact with the track which substantially determines at least the initial phase of the rolling movement of the foot towards the inside ball region thereof. If the runner does not make contact at the correct location at the outside edge of the sole, then correction of the rolling movement of the foot occurs during such rolling movement, and that correction prevents the immediate and full application of power to the track and consequently represents a drop in efficiency. As long as the runner is fresh, he succeeds in making the first contact with the track in such a way as to provide for an optimum rolling movement of the foot. However, when the runner becomes just slightly fatigued, there is a tendency to make first contact with the track, with regions of the foot which are further towards the rear thereof; finally, when the runner is more seriously fatigued, that tendency results in the heel making first contact with the track. Due to the point at which the foot makes contact with the track being shifted further rearwardly from the outside ball region of the foot however, the tendency to sink back on to the heel in turn becomes more and more pronounced.

There are already many proposals for better controlling the way in which the foot is put on to the track, and the subsequent rolling movement from the outside region to the inside region of the ball of the foot, even when the runner is suffering from a certain amount of fatigue, by virtue of a suitable configuration of running shoes. Thus, running shoes are known in which the hard front sole which carries the gripping elements has a support edge which laterally embraces the upper portion of the shoe in the outer ball region and which blends into the hard front sole with a relatively large rounded configuration (German laid-open application (DE-OS) No 28 05 426). The intention with that design is that the rolling movement from the moment of first making contact with the track until the end of that movement is controlled by that rounded configuration.

Admittedly, that shoe construction has proven to be advantageous insofar as, due to the above-mentioned support edge, the runner does not need firstly to try to achieve a secure condition of support on the track in order then to initiate and perform the rolling movement of the foot, but rather the runner can immediately put the foot full on the track and can also already apply leg power to the track, because, when the foot is correctly set down on to the track, the rolling movement automatically takes place over the hard front sole portion with the support edge. However, even that support edge cannot initiate a satisfactory rolling movement if runner fatigue means that the point at which the foot is put on to the track moves further rearwardly in relation to the foot, because the support edge which is also somewhat curved in the longitudinal direction of the sole readily permits the foot to make contact with the track in that way.

It is also already known in relation to a running shoe of the kind set forth in the opening part of this specification, for a cushion of elastic material to be arranged behind the rearmost gripping elements of the front sole, wherein the cushion projects downwardly beyond the front sole (German laid-open application (DE-OS9 No 31 15 488). That cushion is intended to reduce the impact when the foot makes contact with the ground, and it is intended to contribute to the runner keeping contact with the ground in the region of the ball of the foot, and not being able to swing back on to the heel. However that running shoe also does not provide a decisive improvement because the cushion which projects downwardly beyond the front sole necessarily comes into contact with the ground first, more specifically relatively far behind the outside ball region of the foot, so that it interferes with first contact with the track in the outside ball region, which the runner is endeavouring to achieve. As the cushion projects downwardly and is therefore yielding, its capability of controlling the initiation of the rolling movement of the foot from the outside ball region to the inside ball region is only poor. For, because of the flexible nature of the cushion, it leaves the runner considerable scope to try to achieve contact with the track at the correct location on the foot, in dependence on the level of concentration and the strength of the runner.

Finally, a running shoe is also already known in which a heel portion is provided in the form of a heel member consisting of a resiliently yielding material which prevents the foot from tipping back from the front sole to the heel of the foot and which, by virtue of the elasticity of the heel member, is even intended to produce an acceleration component in the direction in which the runner is running (German patent specification No. 2 720 849). As however that heel member is so low that it does not come into contact with the track as long as the runner is in full possession of his strength and is rolling on the forefoot from the outside ball region to the inside ball region, he can basically prevent the point at which the foot first makes contact with the ground moving rearwardly, only when that has already occurred to a certain degree. Then however the foot of the runner has already departed from the stretched condition thereof to such an extent that the desired rolling movement over the ball of the foot and the instantaneous application of power to the ground can only occur, with a time delay.

SUMMARY OF THE INVENTION

The invention is therefore based on the object of providing a running shoe of the kind set forth above, which permits the runner better to maintain the foot attitude required for optimum efficiency, when running.

In accordance with the invention, that is achieved by the features of the running shoe as described hereinbelow.

The invention is based on the notion that the region of the outsole, which adjoins the front sole, is to be utilised for support purposes in such a way that, even with an increasing tendency on the part of the runner to make contact with the ground further rearwardly on the foot, there is a substantially unaltered rolling movement over the ball region of the foot. For that purpose, the arrangement of the wedge-shaped support member, which increases in thickness in a rearward direction, rearwardly of the front sole, firstly causes the foot to be brought into an extended position for emphasising contact with the ground, with the front outside ball region of the foot. In addition, the wedge, with its underside, forms a continuation of the ground-engaging side of the front sole as it is in the same plane as the latter, so that the outer edge of the wedge also represents a continuation of the outer edge of the sole. If therefore a drop in strength causes the runner to develop an increasing tendency to move his weight, on first making contact with the track, further rearwardly on to the outer edge of the sole, the wedge-shaped support member prevents a corresponding sinking movement of the heel. On the contrary, the fact that the support member and the front sole lie in the same plane provides in the region of the outer edge of the sole a 'tilting axis' which moves the foot into the correct initial position from which the rolling movement towards the inside ball region takes place. As the wedge member comprises a material which is relatively hard, even if generally pressure-deformable, and as the wedge member does not project downwardly beyond the front sole, the wedge member cannot be compressed by the loading applied when the foot makes contact with the track, to such an extent that its capacity for returning the foot into the desired position is adversely affected thereby. That function is substantially assisted by virtue of the fact that the sole wedge member extends relatively far into the shank region of the sole. For in that way the foot of the runner is supported at a location which is still rearwardly of the rearward matatarsal joints which are adjacent the anklebone.

It will be seen from the above-described function that the support wedge member must at any event be provided in the region of the outside edge of the sole, where it extends into the region of the shank portion of the sole. As in the rolling movement the foot experiences a torsional effect between the forefoot and the rear foot, about an axis extending in the longitudinal direction of the foot, then in the region of the shank portion of the sole contact with the ground in the region of the inner edge of the sole also occurs comparatively early. For that reason it is desirable for the support wedge member also to be provided in the region of the inner edge of the sole. In order to keep deformation of the wedge member within the desired low limits, it is desirable for the wedge member to be designed to extend continuously into the shank portion of the sole, in which connection it is possible to envisage the provision of a recess which is of a closed boundary configuration, between the edges of the sole, for reasons of weight.

In accordance with an advantageous embodiment, it is provided that the front sole which comprises hard plastic material, for example polyamide, is extended rearwardy beyond the underside of the wedge member, and thus covers over the wedge member. As the material of the front sole is in practice not pressure-deformable but is flexurally elastic, the extension of the sole does not provide any significant stiffening effect because due to the pressure-deformability that the wedge member still enjoys, the sole can flex at least to the same extent. That applies in particular when—as mentioned above—the wedge is provided only along the outer and inner edges of the sole, for reasons of weight, so that the extension portion of the front sole is of a corresponding fork-shaped configuration, or when a weight-saving recess is provided in the wedge member and correspondingly also in the front sole extension portion.

In accordance with a further advantageous configuration the outer edge of the front sole is extended upwardly over the upper portion of the shoe to provide a support cup arrangement, in the region between the outer ball of the foot and the shank portion. As described in the opening part of this specification, extending the outer edge of the sole upwardly in that way is in principle admittedy already known, but in the region of the outside ball portion. In the case of the running shoe according to the invention, the support cup formed by the upwardly extended edge of the sole is disposed behind the outside ball region, in order thereby to restore the foot to the correct initial position for the rolling movement thereof, in the same manner as described hereinbefore in connection with the support wedge member.

Other advantageous constructions are set forth in further subsidiary claims.

BRIEF DESCRIPTION OF THE DRAWINGS

An embodiment of the invention is described in greater detail hereinafter with reference to the accompanying drawings in which.

DETAILED DESCRIPTION OF THE PREFERRED EMBODIMENTS

Figure 1:
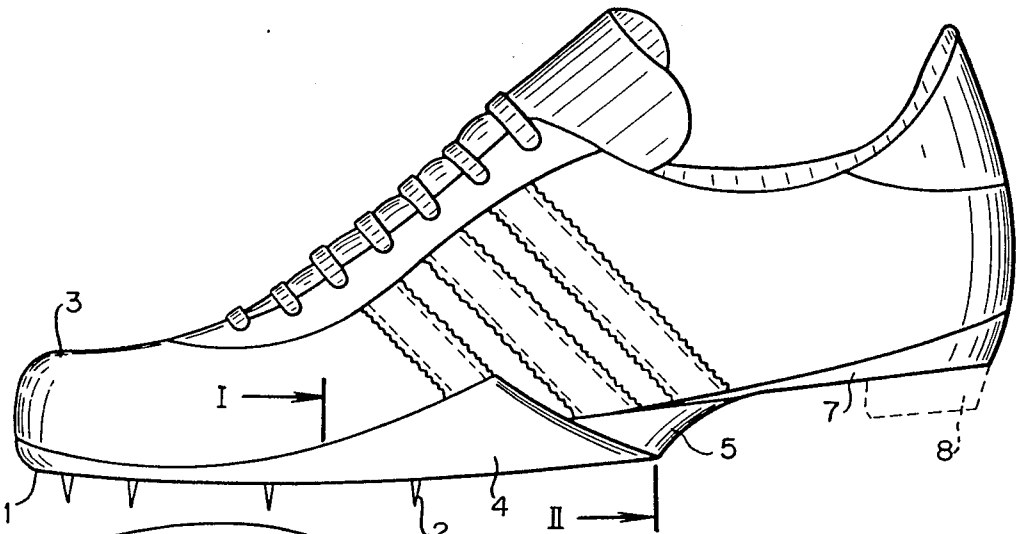
FIG. 1 is a side view of a running shoe according to the invention.

The running shoe shown in the drawing has a front sole 1 to which gripping elements 2 are non-releasably or interchangeably secured. The front sole 1 comprises a relatively hard material, for example polyamide which is set to a hard condition, and which is practically not deformable by pressure and which can carry the forces transmitted by the gripping elements 2 when the person wearing the shoe is running. For that purpose the front sole 1 is of a thickness of between 1 and 2 mm.

As shown in FIG. 1, the front sole 1 is of a slightly cupped configuration, that is to say it is extended upwardly by a few millimeters on the outward side of the upper portion 3 of the shoe, from the tip of the shoe to the region of the ball of the foot (which is indicated by I). On the other hand, beginning from the outside ball region I and extending into the shank portion II of the sole, the front sole 1 is extended upwardly to provide a support cup 4 which is approximately triangular in side view and which extends upwardly by about 1.5 to 2 cm on the outside of the upper portion 3 of the shoe. In comparison with the conventional running shoes in which the front sole terminates directly behind the rearmost gripping elements, in the illustrated shoe the front sole 1 is extended into the shank region II and thus covers over a support wedge member 5 which is fixed to the underside of a (partial) insole (not shown). The wedge member 5 comprises a foam material which is relatively hard but elastically pressure-deformable, for example polyurethane. The material of the support wedge member 5 is at least of a hardness of 40 Shore A, preferably 45–50 Shore A, and reaches 70 Shore A. The support wedge member 5 is of such a configuration that it is about 13 to 14 mm in thickness, beginning at the end of the outside ball region I, in the shank region II. That provides that in the shoe the foot is in a certain stretched position from the outset; when the front sole is put flat on to the track, that stretched position of the foot prevents the heel from making contact with the track.

Figure 2:
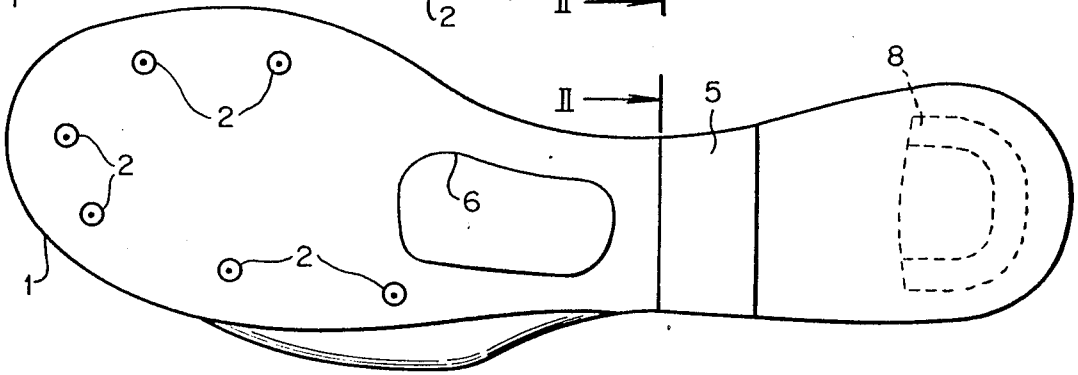
FIG. 2 is a view from below of the running shoe shown in FIG. 1.

As shown in FIG. 2, the wedge member 5 and the extended front sole 1, in the part behind the rearmost gripping element 2, have a recess 6 which is of a closed-edge configuration and from which the material of the wedge member 5 is removed to such an extent that it is of a depth of about 5 to 10 mm. That reduces the weight involved, without adversely affecting the above-described supporting and guiding function of the wedge member 5.

In addition, provided under the rearward part of the upper portion 3 of the shoe, beginning approximately in the shank region II, there is a rear sole 7 in the form of a very flat cup which also comprises a comparatively hard plastic material, for example polyamide. As shown in FIG. 1, the cup shape of the rear sole 7 becomes more pronounced in a rearward direction so that, in the region of the apex line of the heel, the cup shape of the rear sole 7 extends upwardly over a distance of about 5 mm over the upper portion 3 of the shoe. In that region, as shown in broken lines, a low heel member 8 may be fixed under the rear sole 7. The heel member 8 is recessed in a horseshoe-shape, for reasons of weight, as shown in FIG. 2. The heel member 8 may comprise the same relatively hard but elastically pressure-deformable material which forms the wedge member 5. It is also possible however to use a more flexible material for the heel member 8. As FIG. 1 shows, the height of the heel member 8 is so small that, when the running shoe stands flat on the front sole 1, the heel member 8 does not touch the track. The above-mentioned height of the wedge member 5 in the shank region 11, namely about 13 to 14 mm, provides a spacing of about 2 cm between the track (not shown) and the underside of the rear sole 7. In comparison therewith, the height of the heel member 8 is about 1 cm and the heel member 8 serves to safeguard against tipping back.

It is possible to deviate from the above-described embodiment, in accordance with the scope of the invention. Thus, the illustrated slightly cup-shaped configuration of the front sole 1 is not absolutely necessary. On the contrary, even without the configuration of the support cup 4, the front sole 1 may extend in the form of a substantially flat sole plate into the shank region II in order to cover over the underside of the wedge member 5. On the other hand however the front sole 1 may also extend in conventional manner only to a position only just behind the rearmost gripping elements 2 so that the extension of the ground-engaging surface of the front sole 1 is formed by the underneath surface of the wedge member 5 itself. The rear sole 7 which is in the form of a flat cup is also not absolutely necessary. In place thereof, it is possible to provide a light outsole of thin rubber or the like, which is possibly profiled or patterned on its underside.

Figure 3:
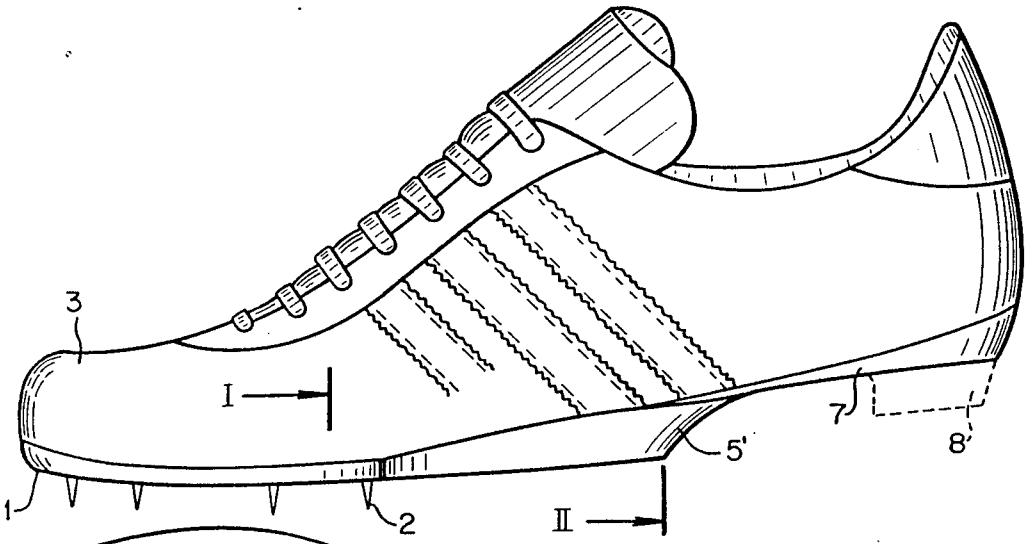
FIG. 3 is a side view of an alternative embodiment of a running shoe of the present invention.
Figure 4:
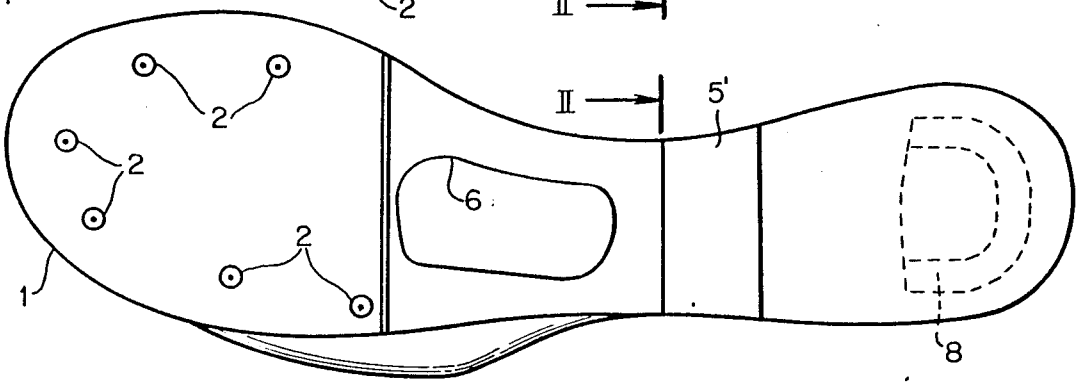
FIG. 4 is a view taken from below the running shoe shown in FIG. 3.

In an alternative embodiment of the running shoe of the present invention illustrated in FIGS. 3 and 4, the running shoe of FIGS. 1 and 2 is shown with the following modification. The wedge 5' with its underside, forms a continuation of the ground engaging side of the front sole as it is in the same plane as the latter, so that the outer edge of the wedge 5' represents a continuation of the outer edge of the sole, as shown in FIG. 3.

By virtue of the fact that in accordance with the invention the underside of the wedge member is one plane with the front sole, the wedge member does not on its own carry the full loading, or at least does so only for an extremly short time, when the foot makes contact with the track, because the front sole which adjoins the wedge member is used directly for providing further support. Its elasticity which is kept within the limits of the specified Shore hardness is therefore adequate for the above-described control function in relation to the rolling movement of the foot. If the wedge member is covered over on its underneath side, as in the above-described embodiment, by the front sole which consists of hard plastic material and which is extended rearwardly to that extent, then the hardness of the wedge member can be chosen at the lower limit of the specified range of Shore hardnesses, because the hard outsole layer provides for a notional increase in the hardness of the wedge member. If on the other hand the wedge member itself forms the ground-engaging surface, then the hardness of the wedge member can be increased towards the upper limit.

What is claimed is:

1. A track shoe comprising:

an upper; and a sole attached to said upper, said sole having an outer side edge, an inner side edge and a shank region and including a front sole portion of hard plastics material, said front sole portion having a ground engaging side, a rearward edge and a plurality of gripping element holding means distributed on said ground engaging side in a predetermined pattern which provides a rearmost gripping element holding means, said sole further including a wedge-shaped support member of an elastically compressible material arranged behind said rearmost gripping element holding means and increasing in thickness in a rearward direction, said wedge-shaped support member having an underside approximately in one plane with said ground engaging side of the front sole portion and including a first part associated with said outer side edge of said sole, and at least said first part of said wedge-shaped support member extending into said shank region of said sole, whereby said underside of said wedge-shaped support member forms a continuation of said ground engaging side of said front sole portion.

2. The track shoe according to claim 1, wherein said wedge-shaped support member directly adjoins said rearward edge of said front sole portion.

3. The track shoe according to claim 1, wherein said wedge-shaped support member has a second part associated with said inner sole edge of said sole, said second part extending into said shank region of said sole, and wherein said wedged-shaped further includes a cavity in the underside of said wedge-shaped support member between said inner and outer side edges of said sole.

4. A track shoe comprising:

an upper: and a sole connected to said upper, said sole having an outer side edge, an inner side edge, an outside ball region and a shank region and including a front sole portion of hard plastics material, said front sole portion having a ground engaging side and a plurality of gripping element holding means distributed on said ground engaging side in a predetermined pattern, said sole further including a wedge-shaped support member of an elastically compressible material having an underside and increasing thickness in a rearward direction, said wedge-shaped support member including at least a part associated with said outer side edge of said sole which is arranged to extend from said outside ball region into said shank region, and said front sole portion having a rearward extension extending into said shank region of said sole and covering said underside of said wedge-shaped support member, whereby said rearward extension forms a continuation of said ground engaging side in one plane therewith.

5. The track shoe according to claim 4, wherein said front sole portion and said wedge-shaped support member have a cavity in said ground engaging side and said underside, respectively, between said inner and outer side edges of the sole.

6. The track shoe according to claim 4, wherein said front sole portion has an outer region associated with said outer side edge of said sole, said outer region curving upwardly to extend over said upper of said shoe between said outside ball region and said shank region so as to provide a support cup.

* * * * *